United States Patent [19]

Vexler

[11] Patent Number: 4,773,976

[45] Date of Patent: Sep. 27, 1988

[54] METHOD OF MAKING AN INSULATED ELECTRICAL CONDUCTOR

[75] Inventor: Gavriel L. Vexler, Montreal West, Canada

[73] Assignee: Northern Telecom Limited, Montreal, Canada

[21] Appl. No.: 851,626

[22] Filed: Apr. 14, 1986

[51] Int. Cl.[4] ..... C25D 7/06

[52] U.S. Cl. ..... 204/28; 174/102 P; 174/118; 204/30; 204/38.4; 427/118; 427/205

[58] Field of Search ..... 427/118, 205; 204/38.4, 204/28, 30, 20; 174/36, 102 C, 102 P, 102 SC, 106 SC, 118, 120 SC

[56] References Cited

U.S. PATENT DOCUMENTS

| | | | |
|---|---|---|---|
| 4,048,042 | 9/1977 | Quinn | 204/206 |
| 4,383,132 | 5/1983 | Bentuelsen | 174/120 SC |
| 4,425,382 | 1/1984 | Tajima | 427/203 |
| 4,503,284 | 3/1985 | Minnick et al. | 174/36 |
| 4,581,291 | 4/1986 | Bongianni | 428/381 |

OTHER PUBLICATIONS

R. V. Stuart, Vacuum Technology, Thin Films, and Sputtering, Academic Press, New York, 1983, pp. 130–131.

F. A. Lowenheim, Electroplating, McGraw-Hill Book Co., New York, 1978, pp. 416–420.

*Primary Examiner*—John F. Niebling
*Assistant Examiner*—William T. Leader
*Attorney, Agent, or Firm*—R. J. Austin

[57] ABSTRACT

A telecommunications conductor is produced by coating it with a visco-elastic dielectric material and then providing an electrically conductive material around the conductor by bombarding the visco-elastic material with particles of the conductor material and changing the visco-elastic material into hardened form. A shielding layer is provided by causing the particles to adhere to the surface of the dielectric material and when the particles provide a conductive path, the layer is completed by applying conductive material by electrolytical deposition or by plasma coating. Alternatively in an insulated conductor provided with a continuous inductive loading, the particles are caused to enter into and become discretely embedded within the visco-elastic material.

4 Claims, 1 Drawing Sheet

METHOD OF MAKING AN INSULATED ELECTRICAL CONDUCTOR

This invention relates to insulated electrical conductors.

In the manufacture of a telecommunications conductor for signal transmission, it is normal to provide a dielectric layer surrounding the conductor. In some constructions it is also required to have a shielding layer surrounding the dielectric layer. Such shielding layers are conventionally provided in one method by wrapping a metal tape around the dielectric layer and welding longitudinal edge regions of the tape together. According to another method, a shielding layer is provided by hot-forming a seamless shield and applying it around the dielectric layer. The above processes have the disadvantage that they are expensive and add inordinately to the cost of the finished shielded and insulated conductor.

In another disclosed construction and to help minimize attenuation increase in signal transmission as operating frequencies increase, a dielectric layer surrounding a conductor acts as a carrier for ferromagnetic particles which are discretely embedded within the dielectric layer. Various methods have been suggested for applying the dielectric layer and its embedded particles to the conductor but these methods are considered to be either impractical or expensive to follow. One of these methods involves the application of a mixture of the carrier and the particles to the conductor surface.

The present invention is concerned with a method of overcoming or reducing the above problems. The invention relates to applying the dielectric layer as a coating of a visco-elastic dielectric material i.e. a cohesive, sticky material which will return to its original shape after deformation, bombarding the visco-elastic material with particles of conductive material, and hardening the visco-elastic material.

Accordingly, the invention provides a method of providing an electrically conductive material around a conductor comprising coating the conductor in a visco-elastic dielectric material, bombarding the visco-elastic dielectric material with particles of the conductor material, and treating the visco-elastic material to change it into a hardened form.

Bombardment may be caused by spraying the particles, e.g. by use of an airless spray device. Alternatively, bombardment may be effected by passing the coated conductor through a fluidized bed or over the bed so as to be bombarded by particles thrown upwardly from the bed.

For the purpose of forming a shielding layer surrounding the coating, this is performed in two stages. In a first stage bombardment of the particles takes place. The degree of visco-elasticity and the speed of bombardment are controlled so that the particles are caused to adhere to surface regions of the dielectric material. The bombardment is continued until there are sufficient particles in the surface regions to form an electrically conductive path along the dielectric material. The shielding layer is then completed in a second stage by applying conductive material to the visco-elastic material either by electrolytical deposition or by the plasma sputtering.

Alternatively, and to provide an insulated conductor construction in which attenuation increase is to be resisted as operational frequencies increase, then the degree of visco-elasticity and speed of bombardment are controlled so that particles are caused to enter into and become discretely embedded within the visco-elastic material.

In order to assist in controlling the depth to which the particles are caused to enter the visco-elastic material, in one method the conductor is coated with an inner layer of dielectric material and an outer layer is applied around the inner layer. With the outer layer having a lower viscosity than the inner layer, it is bombarded with particles which penetrate through the lower viscosity outer layer, but not into the inner layer. Thus, the thickness of the outer layer controls the depth to which the particles may penetrate. In a practical way of providing a dual dielectric layer, an inner layer of one material, e.g. a composition based upon polyvinylcloride, is provided and then after the inner layer has substantially solidified, an outer layer of another material, e.g. nylon, is applied. Such a material should have a melting temperature which is lowe than the softening temperature of the inner layer so as not to cause layer deformation. With this arrangement, the particles are applied to the outer layer with the inner layer solidified. The two layers may be applied in two separate passes of the conductor through extrusion apparatus. Alternatively, the conductor may be passed through two spaced apart and in-line extruder cross-heads on a single pass while ensuring that the inner layer is sufficiently solidified to prevent its degradation or stripping as it moves through the cross-head for applying the outer layer.

Embodiments of the invention will now be described by way of example, with reference to the accompanying drawings in which.

Figure 1:
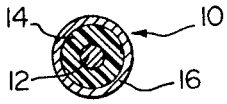
FIG. 1 is a cross-sectional view, on a large scale through an insulated conductor surrounded by a metallic shielding layer.

In FIG. 1 is shown a shielded and insulated conductor 10 comprising an inner conductor 12 surrounded by a thermoplastic polymer insulation 14 which supports a surrounding continuous metallic shield or coaxial conductor 16 thus providing a coaxial conductor construction. The outside diameter of the construction may lie between 0.25 and 0.5 inches.

In a first embodiment, to insulate the conductor 12 and provide it with the shield, it is subjected to the following process.

Figure 2:
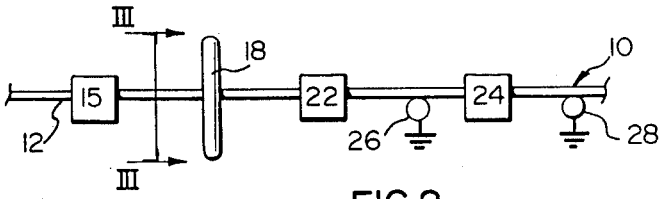
FIG. 2 is side elevational and diagrammatic view on a smaller scale than FIG. 1, of apparatus according to a first embodiment for insulating and forming the metallic shielding layer upon the conductor.
Figure 3:
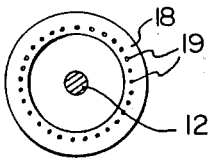
FIG. 3 is a cross-sectional view taken along line III—III in FIG. 2.

In a first stage of the process, the conductor 12, as shown in FIG. 2, is passed through an extruder head 15 of an extruder (not shown) and is surrounded in the extruder with a layer of polymeric extrudate for forming the insulation 14. As the conductor 12, surrounded by the extrudate, issues from the extruder head and while the extrudate has certain visco-elastic characteristics, i.e. before drying, then it is passed through a device which bombards the surface of the visco-elastic extrudate material with metal particles. This device 18 is a known type of airless spray device for particulate material. The device 18 is an annular tube which, as shown in FIG. 3, surrounds the extrudate covered conductor as it moves along its path. The tube has inwardly directed orifices 19 which direct a spray of particles 20 towards the extrudate covered conductor as it passes through. Because of the speed of bombardment and also because of the visco-elastic properties of the extrudate, the particles are caused to adhere to the surface regions only of the dielectric material, with negligible penetration of the material by the particles.

Figure 4:
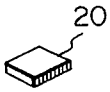
FIG. 4 is a magnified view of a metallic particle to show its preferred shape.

To assist in the adherence of the particles to the visco-elastic extrudate, it is of assistance if the particles are of planar shape to present flat surfaces to the extrudate. In one construction, the planar particles (FIG. 4) have a thickness of between 20 and 100 microns. The particles may be rectangular or square, for instance. In the latter case, each side may measure in the region of 0.4 mil.

Figure 5:
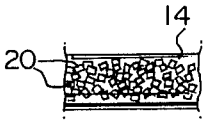
FIG. 5 is a surface view on the scale of FIG. 1 of a partly shielded and insulated conductor after passing through a curing chamber of the apparatus.

The speed of the passage of the conductor through the device 18 and the rate of bombardment with the particles is such that upon leaving the device 18, the visco-elastic material of the extrudate is covered with sufficient particles, as shown by FIG. 5, to present an electrically conductive network on the conductor extending downstream along its feedpath. As will be seen from a later stage in the process, it is essential for the particles to form an electroconductive structure in this way.

The insulated conductor bearing the network of particles is then passed through a curing chamber 22 in which the extrudate is hardened as by curing or drying.

As a second stage in the process, metal is added to the network of particles to form the complete metallic shielding layer. In this embodiment, the shielding layer 16 is completed by electrolytic deposition. As can be seen from FIG. 2, the insulated conductor, bearing the network of particles, is fed into an electrolytic chamber 24 in which an anode of the material is provided. A current is passed through the network of particles from positions, one at each side of the electrolytic bath 24, for instance by electrical contact with two rollers 26 and 28, one at each side of the bath. The electrolytic process takes place in conventional fashion. The thickness of the shielding layer can be controlled as desired not only by the control of the electric current but also by the speed of passage of the conductor through the bath. The finished shielded and insulated conductor 10 is then as shown in FIG. 1.

As will be appreciated, the problems relating to the previous methods of shielding or forming coaxial conductors are avoided by the process of the invention and as described in the first embodiment.

Figure 6:
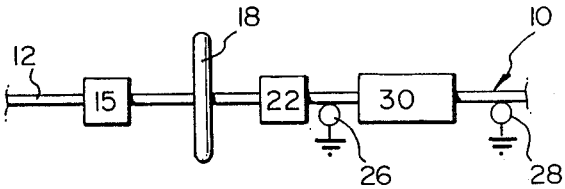
FIG. 6 is a view similar to FIG. 2 of apparatus according to a second embodiment for making the shielded and insulated conductor of FIG. 1.

In a second embodiment for providing the conductor shown in FIG. 1, apparatus as shown in FIG. 6, which is otherwise the same as that shown in FIG. 2, is operated without the use of the electrolytic bath 24. Instead of the bath 24 there is included a plasma sputtering chamber 30 through which the conductor is passed after the extrudate has been coated with the network of particles and has been dried and cured as described in the first embodiment. Plasma coating of the insulation then takes place by conventional plasma sputtering methods.

Figure 7:
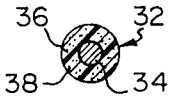
FIG. 7 is a cross-sectional view on the scale of FIG. 1 of an insulated conductor according to a third embodiment, containing ferromagnetic particles in the insulation for forming a continuous inductive layer along the conductor.

In a third embodiment, an insulated conductor 32 as shown in FIG. 7 comprises a conductor 34 covered with a dried layer 36 of latex and having embedded therein discrete particles 38 of a ferromagnetic material. This discrete arrangement of the particles within the latex provides the conductor with a continuous inductive loading for the purpose of increasing the relative magnetic permeability of the conductor and helping to minimize attenuation increase in signal transmission as operating frequencies increase.

The construction shown in FIG. 7 is made in the apparatus shown in FIG. 2 while avoiding the use of parts of the apparatus downstream from the curing chamber. The conductor is coated in the extruder 14 and then passes through the powder airless spray device 18 as discussed above. The visco-elasticity of the covering latex material is such that in conjunction with the speed of bombardment of the particles, the force of impingement of the particles upon the latex causes them to enter into and become discretely embedded within the latex. Thus the conductor 34 is provided with a continuous inductive layer while avoiding the previous problems associated with producing and applying a mixture of viscous carrier and particles to the conductor. By the present process, the method of constructing the insulated conductor of FIG. 7 is simplified by applying the carrier, i.e. the latex, and then the ferromagnetic particles to the conductor in two different stages.

Figure 8:
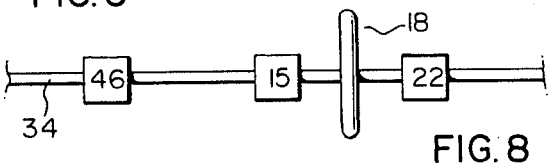
FIG. 8 is a view similar to FIG. 2 of apparatus according to a fourth embodiment.
Figure 9:
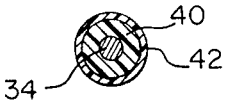
FIG. 9 is a view similar to FIG. 1 of an insulated conductor made by the apparatus of FIG. 8.

In a fourth embodiment shown in FIG. 8, apparatus is provided for providing an insulated structure as shown in FIG. 2 while avoiding parts of the apparatus downstream from curing chamber 22. As shown in FIG. 9, the conductor 34 is surrounded by an inner layer 40 of one polymeric dielectric material and an outer layer 42 of another polymeric dielectric material in which discrete particles of a ferromagnetic material are embedded. As in the third embodiment, a continuous inductive loading is provided by these particles and the depth of the particles from the surface of the insulated conductor is controlled by the thickness of the outer layer as will now be described.

In the embodiment of FIG. 8, the apparatus is identical with that of FIG. 6 except for the location of an extruder having extruder head 46 upstream from extruder head 15.

The conductor 34 is fed through extruder head 46 to be coated with a molten polyvinylchloride composition to form the inner layer 40. With the inner layer cooled to solidify it sufficiently to enable it to pass through the extruder head 15 without damaging the inner layer, the conductor is then passed through the head 15 to be coated with a molten material, e.g. nylon, which has a molten temperature which is lower than the softening temperature of the material of the inner layer. The thickness of the outer layer is consistent with the depth required for the continuous inductive loading, which may for instance be between 1 and 6 mil. The coated conductor is then passed through the powder airless spray device 18 which operates as discussed above in that the visco-elasticity of the unsolidified nylon is such that in conjunction with the speed of bombardment of the particles, the force of impingement of the particles upon the nylon causes them to enter into and become discretely embedded within the nylon. The particles cannot extend beyond the depth of the nylon because of the solidified polyvinylchloride beneath which may then be cured, if required, by movement of the coated conductor through the curing chamber 22.

Constructions similar to that of FIG. 7 may be made not only by having a solidified inner layer before applying the ferromagnetic particles, but also by applying the two layers and with the inner layer in a more viscous state than the outer layer, then applying the particles. The greater viscosity of the inner layer prevents the particles from penetrating into the inner layer from the outer layer. The two layers are then solidified and/or cured as required. One convenient method of providing two layers of different viscosities is to apply the layers by known co-extrusion techniques in which the two layers are applied, one directly after the other, through two in-line extrusion orifices in the same extruder head.

What is claimed is:

1. A method of providing electrically conductive material around a conductor comprising coating the conductor in a visco-elastic dielectric material, bombarding the visco-elastic dielectric material with particles of conductive material to cause particles of the conductive material to adhere to surface regions of the dielectric material, proceeding with bombardment of particles to provide sufficient particles in said surface regions to form an electrically conductive path from particle-to-particle along the dielectric material, treating the visco-elastic material to change it into a hardened form, and, either before or after the changing of the dielectric material into hardened form, passing an electric current through the particles and electrolytically forming onto the particles a layer of conductive material which surrounds the dielectric material.

2. A method of providing a particulate material around a conductor comprising coating the conductor with a first layer of molten dielectric material and a second layer of visco-elastic dielectric material, and with the material of the first layer having a visco-elasticity greater than that of the material of the second layer, bombarding the second layer with particles of the particulate material to discreetly embed the particles in the second layer, the greater visco-elasticity of the inner layer preventing the particles from penetrating into the first layer so as to control the depth of penetration of the particles to the thickness of the second layer.

3. A method to claim 2 wherein the visco-elastic material is nylon, the molten dielectric material is polyvinylchloride, and the particles are ferromagnetic particles and are bombarded against and become discreetly embedded within the nylon.

4. A method according to claim 2 comprising bombarding the dielectric material with the particles by passing the dielectric coated conductor through an annular spraying device having inwardly directed orifices which direct a spray of particles inward and spraying the particles at the dielectric material from all sides of the conductor.

* * * * *